United States Patent [19]

Ferrara et al.

[11] Patent Number: 4,775,464

[45] Date of Patent: Oct. 4, 1988

[54] PROCESS FOR SEPARATING MATERIALS OF DIFFERENT SPECIFIC GRAVITIES THROUGH A CLOSED LOOP SYSTEM UTILIZING A LIQUID MEDIUM OF DIFFERENT DENSITIES

[75] Inventors: Gianfranco Ferrara, London; Henry J. Ruff, Southampton, both of Great Britain

[73] Assignee: Prominco s.r.l, Genoa, Italy

[21] Appl. No.: 828,439

[22] Filed: Feb. 10, 1986

Related U.S. Application Data

[63] Continuation-in-part of Ser. No. 680,600, Dec. 12, 1984, abandoned, which is a continuation of Ser. No. 434,544, Oct. 15, 1982, abandoned.

[30] Foreign Application Priority Data

Oct. 22, 1981 [IT] Italy ..... 24651 A/81

[51] Int. Cl.[4] ..... B03B 5/30

[52] U.S. Cl. ..... 209/172; 209/172.5; 209/173; 209/17

[58] Field of Search ..... 209/172, 172.5, 173, 209/13, 17, 18

[56] References Cited

U.S. PATENT DOCUMENTS

| | | | |
|---|---|---|---|
| 2,726,763 | 12/1955 | Rakowsky | 209/172.5 |
| 2,738,069 | 3/1956 | Roller | 209/172.5 |
| 2,754,963 | 7/1956 | Krijgsman et al. | 209/172.5 X |
| 2,781,906 | 2/1957 | Fontein | 209/172.5 |
| 3,282,417 | 11/1966 | Chase et al. | 209/172.5 X |
| 3,687,284 | 8/1972 | Leeman et al. | 209/172.5 X |
| 3,998,728 | 12/1976 | Strauss | 209/172.5 |
| 4,144,164 | 3/1979 | Absil et al. | 209/172.5 X |
| 4,271,010 | 6/1981 | Guarascio | 209/211 |
| 4,325,819 | 4/1982 | Altizer | 209/172.5 X |
| 4,470,901 | 9/1984 | Burgess | 209/172.5 X |

FOREIGN PATENT DOCUMENTS

| | | | |
|---|---|---|---|
| 201865 | 6/1955 | Australia | 209/172.5 |
| 326981 | 3/1972 | U.S.S.R. | 209/172.5 |
| 796550 | 6/1958 | United Kingdom | 209/172.5 |
| 887493 | 1/1962 | United Kingdom | 209/172.5 |

*Primary Examiner*—S. Leon Bashore
*Assistant Examiner*—Andrew J. Anderson
*Attorney, Agent, or Firm*—Diller, Ramik & Wight

[57] ABSTRACT

This invention relates to a process for the dynamic separation of mixtures of materials, such as minerals having different specific gravities, by using one dense medium having two different densities, the process includes a closed loop flow system utilizing two medium streams of two different densities for separating mixtures of materials into two material/dense medium streams. The dense material is recovered from the two material/dense medium streams after separation and splitting by creating two return streams of two different densities which are individually fed to a tub, and the two medium streams are formed from the dense medium of the tubs by effecting overflow of the dense medium between the two tubs to establish substantially equal volume therebetween and maintain equal volume therebetween.

9 Claims, 4 Drawing Sheets

29
32
34
6
80
33
A
5
B
39
40
30
36
7
80
35
31
38
39
40
41
8
80
37
45
42
39
40
46
43
53
65
12
50
47
52
10
11
51
44
48
64
60
22
56
55
58
54
61
15
57
62
63
23
59
16
20
49
66
69
68
1
L
L
2
30
4
67
3
31
18
19
21

81
34
6
80
33
30
39
40
82
36
7
80
35
38
31
39
40
41
8
80
37
45
42
39
40
46
43
65
53
12
50
10
47
52
11
51
44
48
64
60
22
56
55
58
57
54
61
15
62
63
23
59
16
20
49
66
29
69
68
1
L
L
2
67
30
4
18
3
31
19
21

PROCESS FOR SEPARATING MATERIALS OF DIFFERENT SPECIFIC GRAVITIES THROUGH A CLOSED LOOP SYSTEM UTILIZING A LIQUID MEDIUM OF DIFFERENT DENSITIES

This application is a continuation-in-part of application Ser. No. 06/680,600, abandoned, filed on Dec. 12, 1984 which in turn is a continuation application of now abandoned application Ser. No. 434,544 filed on Oct. 15, 1982.

It is known that the processing of raw minerals or raw coals, for the separation and the recovery of the useful fractions on the basis of the different specific gravities of the different particles, must be performed in many a case in two sequential stages, in each of which a cut with different specific gravity is carried out. Let, for example, be considered, in this connection, the teachings of the U.S. Pat. No. 4,271,010 granted on June 2, 1981.

By so doing, it becomes possible to separate three mineral species, for example a species having a high specific gravity, such as baryte, one having an intermediate specific gravity, such as fluorite, and the gangue having a low specific gravity, such as quartz. As an alternative, if the raw materials coming from the mine is composed of two species only, it is possible to obtain a high-grade concentrate, a mixed concentrate, and a sterile one. The mixed concentrate can be processed with other methods in order to concentrate it further, or it can be used as such.

In the field of processing of the raw coals, one can obtain a low-ash coal for special uses, a mixture having a higher ash contents for producing steam or electric power, and a sterile for rejection.

Such processes in which two cuts having a different specific gravities are obtained, for the case of dense-medium dynamic separation (that is with a centrifugal field), according to the procedure in use nowadays, are carried out by serially arranging two installations, each of which works at a different separation density. For example, for processing coal raw materials, the feed stream can be fed to a first installation which carries out the low-density separation and produces a low-ash coal (a lightweight product called also "float") and a heavy product (called also "sink") which is fed to a second installation which carries out the separation with a higher density and gives a mixture (a coal having a higher ash contents) and a sterile to be rejected. Provision can also be made for effecting the high-density separation in the first installation. The errection of two complete installations with two discrete circuits for the dense medium and with two separate systems for draining the dense medium and the leaching of the products coming from the separation to carry out this kind of process, involves a considerable burden as to first and running costs, so that, very often, said approach can not be adopted.

An objective of the invention is, principally, that of providing the two separations at different densities in a single installation, so as substantially to reduce the costs as imposed by the known technology for carrying out said kind of separation.

An additional objective of the invention is to facilitate a conversion of an existing installation for effecting the separation of the two products with a dense medium having one density only in an installation which effects a separation of the three products with a dense medium having two different densities.

In order that these objectives may be achieved, the present invention suggests a process for the dynamic separation of mixtures of materials, such as for example minerals, having different specific gravities, by a dense medium having two different densities, characterized in that streams of the heavy medium recovered at the exit from the separation stages are fed to a single loop adapted to recycle the dense medium to the inlet to the separation stage, said circuit having means for distributing said dense medium streams to said inlet for obtaining therein said two different initial densities.

A subject matter of the invention is also an installation adapted to carry out the process aforesaid.

In order that the features and the advantages of the invention may be better understood, practical examples thereof will now be described with reference to the FIGURES of the accompanying drawings.

It is desired to specify that such examples are not to be construed as limitations of the scope of the invention as substantially defined hereinabove.

Figure 1:
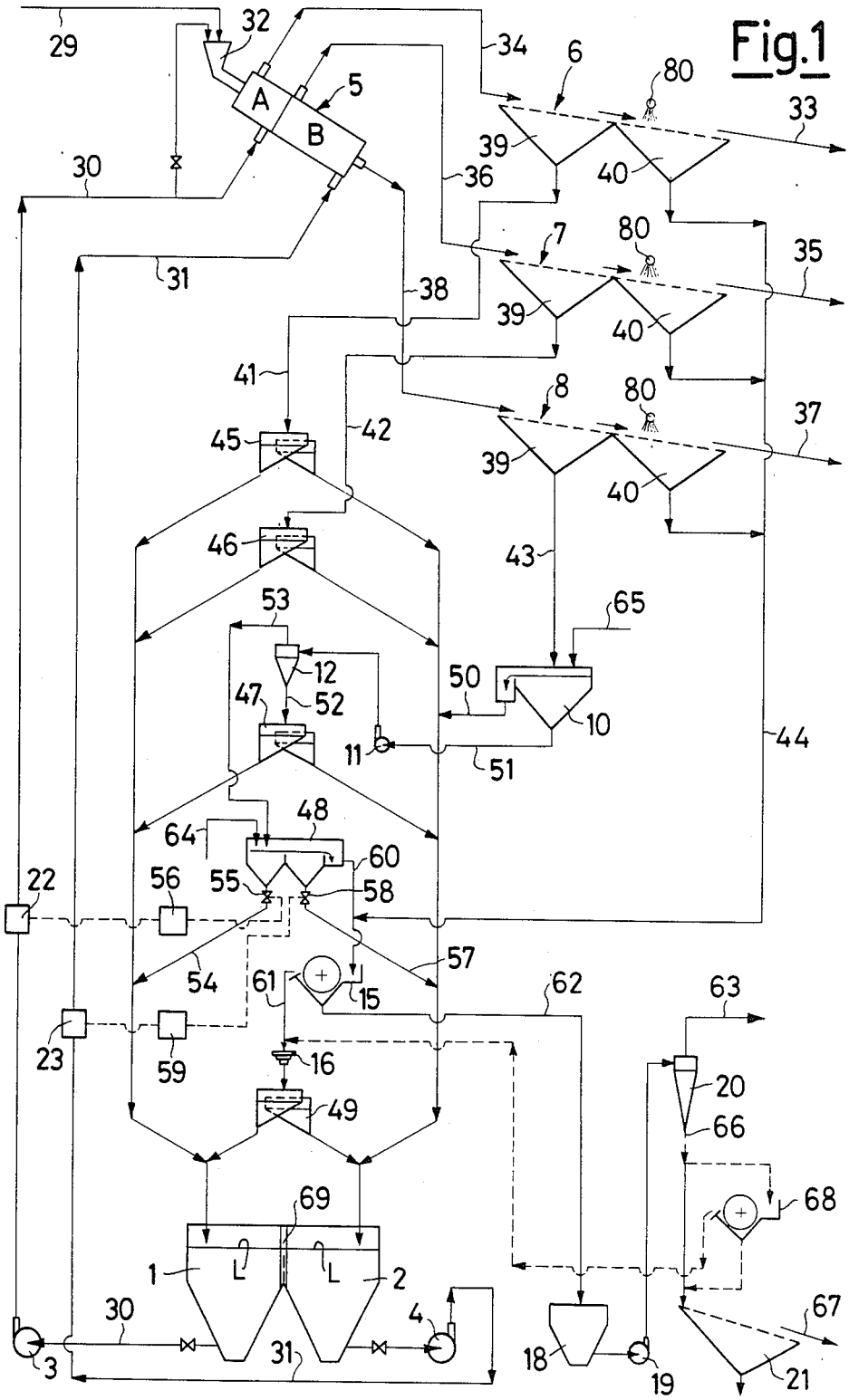
FIGS. 1 and 5 show in their entirety the flow diagrams of two different installations adapted to carry out the process according to this invention.

The installation shown in FIG. 1 comprises a separator 5 in two stages, of the kind disclosed in U.S. Pat. No. 4,271,010 in which the high-density separation is carried out in a chamber A and the low-density separation is effected in a chamber B.

The loop of FIG. 1 has two main tubs for the dense medium: a tub 1 containing a high-density dense medium $d_A$ and a tub 2 containing a dense medium having a low density $d_B$. The two tubs communicate with one another through an opening 69 of the width of which can be adjusted, for example, by a gate (or by inserting elements shaped like bars or panels which close it starting from the bottom) so as to lift the overflow level.

The connection between the two tubs, however, can also be obtained otherwise, such as by tubes arranged at different levels with valves of other members according to the conventional art. The flow of the dense mediums $d_A$ and $d_B$ into (and out of) the respective tubs 1 and 2 is such that a common free uppermost liquid surface level (L, FIG. 1) of the dense mediums $d_A$, $d_B$ in the tubs 1, 2 is maintained spaced above the opening 69 and/or the point of overflow defined thereby (or by the aforesaid gate) between the tubs 1, 2. In this manner the volume of the dense medium $d_A$ in the tub 1 is at all times substantially equal to the volume of the dense medium $d_B$ in the tub 2.

The dense medium of the tub 1 having the density $d_A$, feeds via a pump 3, the chamber A of the separator 5. In the particular case of FIG. 1, a fraction of the total volume rate of flow 30 of the dense medium which feeds the chamber A of the separator, is fed to a feeding hopper 32 together with the mineral to be separated, which comes from 29. The dense medium of the tub 2, having a density $d_B$, feeds, through a pump 4, the chamber B of the separator 5. At 31 there is shown the rate of flow, by volume, of the thick medium from the tub 2.

The separator 5 permits the formation of three end products, viz.: a sink 33 composed of the fraction of the fed mineral which has a density higher than $d_A$ (accompanied by a certain amount of dense medium having a high density). At 34 there is shown the total rate of flow by volume of sink 33 plus dense medium accompanying it.

A sink 35 composed of the fraction of fed mineral having a density comprised between $d_A$ and $d_B$ (accompanied by a certain amount of dense medium having an intermediate density): at 36 there is shown the total rate of flow by volume of sink 35 plus the accompanying dense medium.

A float 37 composed of the fraction of the fed mineral which has a density lower than $d_B$ (accompanied by a certain amount of the low-density dense medium): at 38 there is indicated the total rate of flow by volume of the float 37 plus its accompanying dense medium.

The three products as obtained from the separation, united to their accompanying dense medium indicated above at 34, 36 and 38, are sent to three screens 6, 7 and 8. These three screens, conventional as themselves, are composed of a first draining section 39, that is one in which the dense medium accompanying the products of the separation is drained, and a second leaching section 40, in which water sprinkles from sprinklers 80 leach the two sinks and the float and remove therefrom the dense medium which is recovered, the medium being composed of a suspension of ferrosilicon, magnetite or a mixture of the two in water, which is to be regenerated thereafter (that is stripped of nonmagnetic pollutants) and reused for the processing.

The screens 6, 7 and 8 can be vibratory screens or shock screens: instead of three screens of the kind shown in FIG. 1, a single screen can be provided, which is partitioned into three sections longitudinally, so that the products and the drained dense medium are kept separated. To encourage draining, they can be preceded by fixed screens of the kind of those known in the trade as curved grids, or other screens composed of sloping planar grids, which are useful especially when the volumes of the dense medium to be drained are considerable. The fixed screens of that kind, which can be inserted, if necessary, have not been shown in FIG. 1 because they are conventionally known in art of the dense medium separation.

The three products as obtained by the separation, the sink 33, the sink 35 and the float 37, after having been leached and strained on the screens, are sent to storage or subsequent processing. Through the cross-section 39 of each of the screens 10, 7 and 8 (or through the fixed screens which can be placed upstream thereof) a drained dense medium oozes, which is shown at 41, 42 and 43, respectively. The drained dense medium and the diluted dense medium 44 as obtained by leaching the separation products on the section 40 of the same screens (leaching carried out to remove the ferrosilicon or the magnetite stuck to the materials) are recycled to the dense medium stream.

According to the invention, said dense media are subjected to thickening steps by cyclones if they have a low density, or to thickening and magnetic separation if they contain nonmagentic pollutants, and also to redistributions between the two tubs and 2 by distributors (also called splitters) 45, 46, 47, 48 and 49, so as to rebuild in such tubs the starting densities $d_A$ and $d_B$.

More particularly, the dense medium stream 41, as it comes from the dumping of the sink 34 of the section A of the separator 5, consists of a high-density dense medium, the density of which generally exceeds that, $d_A$, of the tub 1. Thus, the stream 41 must be fed, totally or predominantly, to the tub 1: the splitter 5 must thus be so adjusted as to send all or nearly all the dense medium to the tub 1. In the light of this circumstance, the splitter 45 could even be dispensed with and all the dense medium 41 directly sent to the tub 1.

On the contrary. the dense medium stream 42, having an intermediate density, is split between the two tubs 1 and 2 by the splitter 46, so as to feed the tub 2 with a volume of liquid which is higher than that which had been obtained by using the splitter 45.

The two splitters 45 and 46, as well as the subsequent splitters 7 and 9 are indicated symbolically only in FIG. 1 since it is not necessary to specify the constructional features of them, as they are conventional devices for splitting the liquid streams or slurries continually and according to a variable proportion so as to direct them towards two different directions, in the case in point towards the tub 1 and the tub 2.

The stream 43 coming from the dumping of the float of the separator 5 and consisting of a dense medium having a very low density, is sent to a tub 10 equipped with an overflow system and connected to a pump 11. The pump 11 takes usually a fraction of the total stream entering the tub 10, whereas the remaining fraction 50 overflows and is directly fed to the tub 2 for the dense medium having the low density $d_B$. The stream 51 drawn by the pump 11 is sent to a cyclone or to a cyclone set 12 which produces an underflow 52 having a high density and an overflow 53 having a low density. The underflow 52 is split by the splitter 47 between the two tubs 1 and 2, but it is apparent that by such a splitting an attempt is made to send a major fraction to the tub 1 because 52 has a high density.

The low density overflow 53 is forwarded to a valved splitter 48, or to a 3-way splitter, which splits into:

a stream 54 which can be adjusted either manually or by a variable aperture automatic valve 55 (driven by a governer 56 connected to a density-meter 22) so as to keep adjusted and constant the density of the dense medium $d_A$ of the tub 1;

a stream 57 which can be adjusted by the variable aperture automatic valve 58 (driven by a governer 59 connected to a density-meter 23) so as to keep adjusted and constant the density of the dense medium $d_B$ of the tub 2, and a stream 60 to be sent to a magnetic separator 15 which recovers the ferrosilicon and/or the magnetite (which is recycled to the loop for the dense medium together with the stream 61) and rejects the excess water of the loop and feeds it to the reject of the magnetic separator 62.

The same magnetic separator 15 receives the stream 44 of the diluted dense medium, consisting of leaching water of the screens 6, 7 and 8 with ferrosilicon and/or the magnetite removed from the separation products sink 33, sink 35 and float 37. The magnetic separator 15 recovers, also from said stream of diluted dense medium, the ferrosilicon and/or the magnetite feeding them back to the loop of the dense medium together with the stream 61.

The recovered and thickened ferrosilicon and/or magnetite which are contained in the stream 61 can be demagnetized conventionally by a demagnetizing coil 16 and are then sent to the divider or splitter 49 which splits them according to any desired proportion between the tub 1 and the tub 2.

The magnetic separator 15 can be single, as shown in FIG. 1, or double (wherein the second separator processes the nonmagnetic fraction of the first separator) or also a multistage separator so as to provide a more intensive recovery of ferrosilicon and/or magnetite. The nonmagnetic stream 62 rejected by the separator or the magnetic separators 15 can be sent to the water recovering gate, or it can be sent to a thickening cone or a tube 18 and, through a pump 19, to a cyclone 20. The overflow of the cone or the cyclone 20, shown in FIG. 1 at 63, is virtually composed of water with only a few fine-sized pollutants or residues of ferrosilicon and/or magnetite of a small grit size, so that it can directly be reused in the leaching screens 6, 7 and 8, optionally for a pre-washing, or it can be reused in other spots of the loop wherein water is required, for example at 64 and 65.

The underflow of the cone or the cyclone 20 indicated at 66 can be sent to the sterile storage or it can be sent to a screen 21 to separate from the water the coarser-grain material 67 which is present in the loop due to the crushing of the products of the separation, sink 33, sink 35 and float 37 due to the mechanical action on the screens 6, 7 and 8. Should the underflow 66 still contain ferrosilicon and/or magnetite which had escaped the separator 15, it is possible to insert between the cyclone 20 and the screen 21 another magnetic separator 68 to recover additional magnetic material to be reintroduced into the loop together with the stream 61.

The material 67 coming from the crushing of all the products of separation including the steriles, is not enriched with any useful component. Should it be desired to keep the fines coming from the crushing of the different products of separation separated from each other, it suffices to keep separated from each other the leaching liquors of the screens 6, 7 and 8 and to send them to different magnetic separators such as 15 arranged in parallel, to send the rejects of said separators to three different loops such as those consisting of the apparatus 18, 19, 20 and optionally also to 68 and 21. By so doing, there would be obtained three products such as 67, one of which would come from the sink 33, the other from the sink 35 and the last from the float 37. These products would be products of separation thus susceptible of being used.

Moreover, such a procedure could be very useful when the grit size bottom limit processed by the separator 5 is very low (such as 0.2 mm and under) and when it is desired to use on the leaching screens 6, 7 and 8 meshes having a greater mesh opening (such as 1 mm) to improve the screening of efficiency (and also to reduce the screen bulk). By so doing, with the expedient indicated above, the grit-size range 1 mm+0.2 mm of the products of separation sink 33, sink 35 and float 37 can be recovered in three circuits of the kind of those indicated at 18, 19, 20 and optionally 68 and 2I, arranged in parallel relationship.

An important distinctive feature which characterizes the invention as exemplified in FIG. 1 is the fact that it is possible, through the several divider or splitters 45, 46, 47, 48 and 49, to preferentially direct to the tub 1, wherein there is the dense medium having the high density $d_A$, the fractions having the coarser grit size of the heavy materials (ferrosilicon, magnetite or a mixture of the two) used for making up the slurry, whereas the finer fractions can be sent to the tub 2 in which there is the dense medium having the low density $d_B$.

It is well known in the appertaining art, in fact, that, in order that high densities of the dense medium may be attained, it is required to use heavy materials having a coarser grit size and a heavier weight (ferrosilicon) so that such high densities may not concurrently originate also high viscosities of the dense medium, a fact which would be detrimental to the accuracy of the separation. Likewise, in order to obtain low densities of the dense medium, it is required that heavy material with a finer grit size and a lighter weight be used (magnetite) in order that such low densities may not concurrently originate also a low stability of the dense medium, a fact also which would be detrimental to the accuracy of the separation.

Now, by examining the installation shown in FIG. 1, it is apparent that in the cyclone 12 a certain grit-size selection takes place, as well as a density selection (the latter occurs if the dense medium consists of a mixture of ferrosilicon and magnetite) of the heavier material contained in the steam 51, so that the underflow 52 will predominantly contain the coarser particles and the ferrosilicon (specific gravity about 6.8 g/cm$^3$) and the overflow 53 will prevailingly contain the finer particles and the magnetite (specific gravity of a commercial grade magnetite for dense media is between 3.8 and 4.8 g/cm$^3$). Such a selection by the cyclone 12 will be the more efficient the lower is the concentration of solids in the stream 51. Such concentration of solids is low as itself because the dense medium 43 comes from the dumping of the float of the separator 5: however, if this should not be sufficient, it is possible to reduce the concentration of solid matters further by adding at 65 fresh water or recovered water taken from the stream 63 and/or the stream 44.

In order that the objectives specified in the two previous paragraphs may be achieved, it will suffice to direct the stream 52 (having a coarse grit size and predominantly consisting of ferrosilicon) with a greater rate of flow to the high density ($d_1$) tub 1 by the splitter 47, and the stream 53 (having a finer grit size and containing magnetite prevailingly) at a greater rate of flow to the low density ($d_B$) tub 2 by the splitter 48.

Moreover, on taking into account that ferrosilicon and/or magnetite as recovered by the magnetic separator 15 have a finer grit size as they come partially from the stream 60 still deriving from the stream 53, the stream 61 should be prevailingly fed to the tub 2.

As regards the other streams which feed the tubs 1 and 2, it can be stated that the stream 41 should be predominantly (or even entirely) sent to the tub 1, because it comes from the dumping of the sink 34 of the first stage of the separator 5, which operates also a partial grit size selection by sending to the first sink the coarser particles predominantly; this can be made by the splitter 45. Likewise, the stream 42 shall be split by the splitter 46 between the tubs 1 and 2, but a greater fraction than had been made for the stream 41, shall be fed to the tub 2.

In connection with the adjustment of the density, this can be effected by manually adjusting the aperture of the valves 55 and 58, or automatically if the opening of such valves is served to two governers 56 and 59, driven by the density-meters 22 and 23. If the diluted dense medium 53 is not sufficient to feed the streams 54 and 57 necessary to obtain the expected densities in the tubs 1 and 2, an additional fresh water stream 64 can be fed at 48, or also recycled water or diluted dense medium drawn for example from the stream 44 or 63. As outlined above, in the loop of FIG. 1, the separator 5 has been inserted by way of example only: this invention can be carried out also with other conventional separators or combinations of same, such as exemplified in FIGS. 2, 3 and 4, wherein only the portion of the loop concerning the separators has been illustrated, whereas the remaining portion is the same as in FIG. 1.

Figure 2:
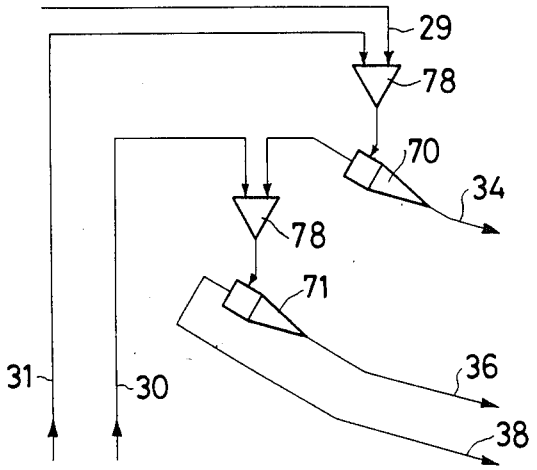
FIGS. 2, 3 and 4 are partial views of the flow diagrams relative to additional different embodiments of the invention. The portions of the diagrams which have not been shown in the latter three FIGURES must be intended as coinciding with that of FIG. 1; the portion of the diagram which has been omitted comprises said loop for recirculating the streams of dense medium to the separation inlet.

According to the example shown in FIG. 2, the two separations are made by two conical cyclones 70 and 71: at 70 the high density separation is carried out whereas the low density separation takes place in 71.

Figure 3:
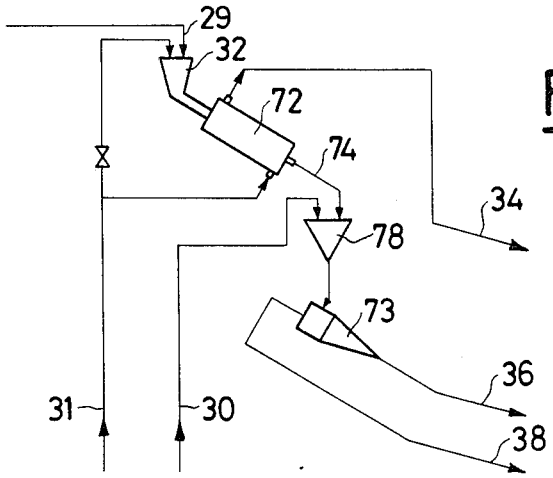

According to the example shown in FIG. 3, use is made of a cylindrical cyclone 72 of the kind known in the trade as the Dyna Whirpool which effects the high-density separation, and of a concial cyclone 73 which carries out the low density separation by treating the float 74 of the first separation. In the example shown in FIG. 4 the sam two apparatus as in FIG. 3 are used differently: in the cylindrical cyclone 75 the low density separation takes place whereas a conical cyclone 76 performs the high density separation by processing the sink 77 of the first separation.

Figure 4:
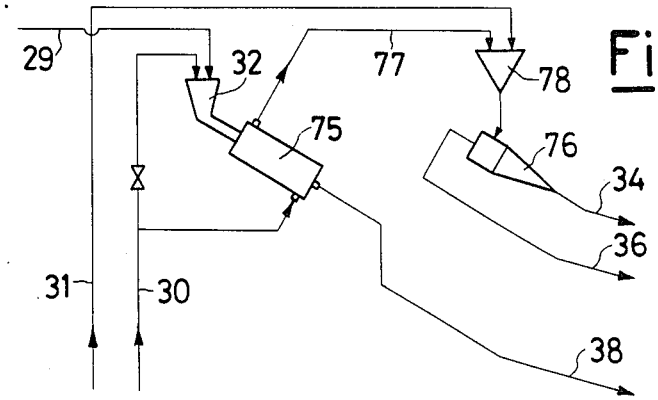

In FIGS. 2, 3 and 4 the conical cyclones are fed by a loading tub 78 the level in which must be kept constant by any conventional expedients. If, however, the minerals to be treated are fine enough, the cyclones can also be fed by pumps.

Figure 5:
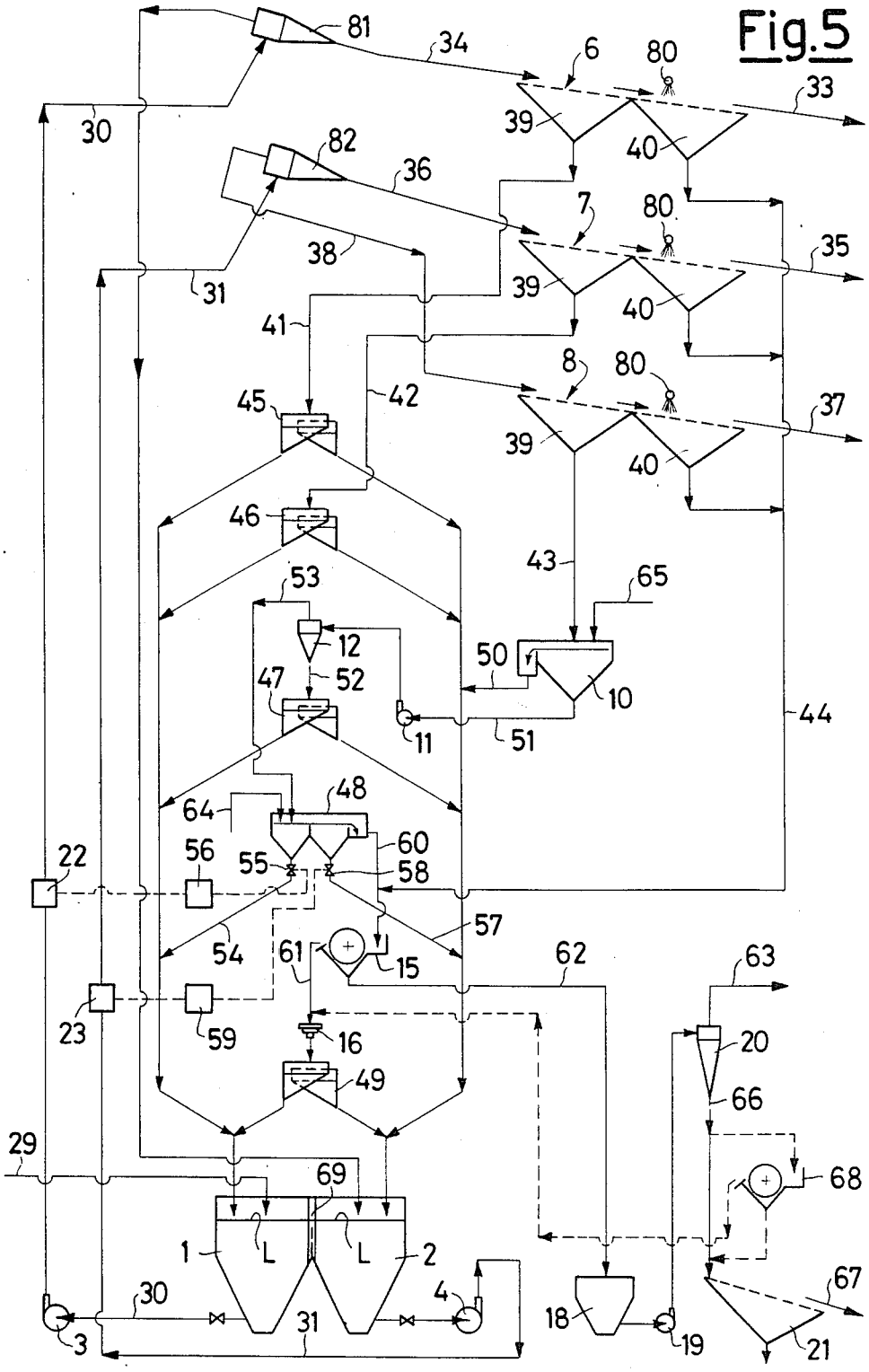

Lastly, FIG. 5 is illustrative of an approach with two conical cyclones 81 and 82, which can be applied when the raw mineral or coal to be processed has a grit size which is fine enough as to be sent from the tubs 1 and 2 to the conical cyclones by the pumps 3 and 4. For the remaining portions of the flow sheets shown in FIGS. 2, 3, 4 and 5, the same reference numerals are used as employed in FIG. 1 to indicate like parts of the installation. Among the numerous modifications which can be adopted over what has been exemplified above, provision can be made to feed the mixture of the materials to be separated together with the dense medium.

The principal features and advantages of the invention are summarized hereunder as follows:

While for the dense medium dynamic separation of a mixture of minerals with cuts having two different densities according to the conventional technique two serially arranged installations are used, each having a loop of its own for the dense medium which is not admixed to the dense medium of the other loop, according to the present invention the same operation can be performed by a single dense medium loop, in which the two media having different densities, as are necessary for the two separations, even though they become admixed together in the separator(s), are subsequently split by dividers or splitters which act upon the different feed back streams so as to reconstitute in the two starting tubs the two initial densities.

A prominent feature of the invention is the fact that the means for thickening and recovering ferrosilicon and magnetite can give rise to a grit-size selection and, in part, to a density selection (according to FIG. 1, the stream 5 will contain coarser particles and more ferrosilicon; the streams 54 and 57 will contain finer particles and more magnetite; the stream 6 will contain finer particles) and the fact that the splitters make it possible to distribute the streams so as to send to the tub 1 the coarser particles and more ferrosilicon and to the tub 2 the finer particles and more magnetite, thus permitting that two dense media having different densities may be obtained with their correct viscosities and stabilities consistent with the requirements of the separation. Another feature of the invention is that the two tubs 1 and 2 may also be caused to communicate with one another, so as to permit to balance the volumes of said two tubs by sending a fraction of the slurry from the tub 1 to the tub 2 or vice versa. The balance of the volumes of the two tubs, which is easy to perform in the way described above, can be obtained, at any rate, also otherwise but with the two tubs not communicating with one another. To do so, it is necessary to provide automatic control systems for the variation of the distribution of the streams in the splitters 45, 46, 47 and 49 or in a few of them at least. However, it is preferable in accordance with the invention to maintain substantially equal volumes in the tubs 1, 2 by the measures heretofore described, namely, maintaining the flow of the dense mediums $d_A$ and $d_B$ into (and out of) the respective tubs 1, 2 such that the common free uppermost liquid surface level (L, FIG. 1) of the dense mediums $d_A$, $d_B$ in the tubs 1, 2 is spaced above the opening 69 and/or the point of overflow defined thereby (or by the aforesaid adjustable gate). The consequence of this is that the level of the free surface in the two tubs is equal, but more importantly the volumes $V_1$, $V_2$ (FIGS. 1 and 5) of the mediums $d_A$, $d_B$, respectively, in the respective tubs 1, 2 is the same or equal.

The latter concept is augmented by a second concept, namely, controlled constant steady state dense medium flow of the dense mediums $d_A$, $d_B$ as established by the splitters 45, 46, 47, 49, etc. With equal volumes $V_1$, $V_2$ and a constant splitter setting(s) the system will in a rapid period of time establish two density values of the dense mediums $d_A$, $d_B$ differing from each other while remaining constant over time because of the continuous flow closed loop system, the equal dense medium heights/volumes in the tubs 1, 2 and the constant splitter setting. Furthermore, if its desired to alter the density values of the dense mediums $d_A$, $d_B$ for separating other fractions/specific gravities of materials, one or all of the splitters 45, 46, 47, 49, etc. need but be changed, as desired, and new density values of the dense mediums $d_A$, $d_B$ are readily and quickly obtained, as will be shown mathematically hereinafter.

For simplicity, reference is first made to FIG. 1 in which the level of the free surface L in the two tubs 1, 2 is the same or equal and, thus, $V_1$ equals $V_2$ in which $V_1$ and $V_2$ are the respective volumes of the dense mediums in the tubs 1 and 2. The total volume V than can be expressed as $V=V_1+V_2$. Further, P is the total weight of the suspensoid (ferrosilicon or magnetite) and $\delta_s$ is the specific gravity of the suspensoid whereby the mean density of the medium in the total volume V can be expressed as:

$$\delta_m = \frac{V - \frac{P}{\delta_s} + P}{V} = 1 - \frac{P}{V}\left(\frac{1}{\delta_s} - 1\right) = 1 - \lambda\left(\frac{1}{\delta_s} - 1\right) \quad (1)$$

where $\lambda = P/V$ is the only parameter on which the value of $\delta m$ depends ($\delta_s$ is constant).

Figure 7:
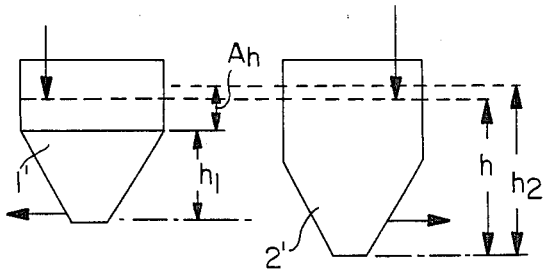
FIG. 7 shows two tubs not in fluid flow communication and having different liquid surface levels.

It is now supposed that the two tubs 1, 2 of equal volume are not in fluid communication, as shown in FIG. 7.

The levels of the free surface of the mediums in the tubs 1', 2' is not equal, the volumes of the medium in the tubs 1', 2' are, therefore, not equal, and the heights of the mediums in the tubs 1', 2' will be represented respectively as $h_1$ and $h_2$.

If $\delta$ is the horizontal cross sectional area of each tub, the mean height is $h = (h_1 + h_2)/2$, and $\Delta h = h_2 - h_1$ is the difference of the heights of the free surface levels in the two tubs. The volumes $V'_1$ and $V'_2$ can be expressed as follows:

$$V'_1 = \delta h_1 = \delta\left(h - \frac{\Delta h}{2}\right) = 2\delta h\left(\frac{1}{2} - \frac{\Delta h}{4h}\right) = V'\left(\frac{1}{2} - \frac{\Delta h}{4h}\right) \quad (2)$$

$$V'_2 = \delta h_2 = \delta\left(h + \frac{\Delta h}{2}\right) = 2\delta h\left(\frac{1}{2} + \frac{\Delta h}{4h}\right) = V'\left(\frac{1}{2} + \frac{\Delta h}{4h}\right)$$

where $V' = 2\delta h$. If K is the proportion which is in the tub 1' of the total ferrosilicon, and $(1-K)$ the proportion which is in the tub 2', the density values of the dense medium in the two tubs is expressed:

$$\delta_1 = \frac{V'_1 - \frac{KP}{\delta_s} + KP}{V'_1} = 1 - \frac{KP}{V'_1}\left(\frac{1}{\delta_s} - 1\right) = 1 - K\frac{P}{V'}\frac{1}{\left(\frac{1}{2} - \frac{\Delta h}{4h}\right)}\left(\frac{1}{\delta_s} - 1\right) \quad (3a)$$

$$\delta_2 = \frac{V'_2 - \frac{(1-K)P}{\delta_s} + (1-K)P}{V'_2} = 1 - \frac{(1-K)P}{V'_2}\left(\frac{1}{\delta_s} - 1\right) = 1 - \frac{(1-K)P}{V'}\frac{1}{\left(\frac{1}{2} + \frac{\Delta h}{4h}\right)}\left(\frac{1}{\delta_s} - 1\right) \quad (3b)$$

Substituting $\lambda = P/V$ in equations (3a) and (3b):

$$\delta_1 = 1 - K\lambda\frac{1}{\left(\frac{1}{2} - \frac{\Delta h}{4h}\right)}\left(\frac{1}{\delta_s} - 1\right) \quad (4)$$

-continued $$\delta_2 = 1 - (1-K)\lambda\frac{1}{\left(\frac{1}{2} + \frac{\Delta h}{4h}\right)}\left(\frac{1}{\delta_s} - 1\right)$$

Equations (4) establish that the density $\delta_1$ and $\delta_2$ in the two tubs $V_1$, $V_2$ depend on the following parameters:

- $\lambda$, that in the required operation conditions has a fixed value which is maintained constant through the control of the density;
- K, that in required operating conditions also has a fixed value that is obtained through a suitable setting of the splitters that divide among the two tubs all the entering flows of medium;
- $\Delta h/h$, the relative difference of levels in the two tubs. If the two tubs are not communicating, this parameter becomes uncontrollable because the flows entering the two tubs do not equal the flows going out. Therefore, the difference of levels will change and consequently $\delta_1$ and $\delta_2$ will have uncontrollable values.

Figure 6:
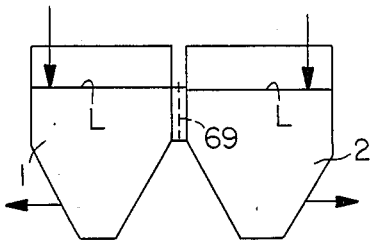
FIG. 6 shows the two tubs of FIGS. 1 and 5 in fluid flow communication establishing a common free uppermost liquid surface level.

In order to avoid the latter, the two tubs 1, 2 are intercommunicating at a common surface level above the opening 69 as shown in FIG. 6. It will be seen that $\Delta h/h$ can be very close to 0 because only a small difference of level $\Delta h$ is necessary to ensure the level L (FIGS. 1 and 5) and flow between the two tubs 1, 2. However, if the communication between the tubs 1, 2 is over a large flow area or section and the flow between the tubs 1, 2 is not excessive, then $\Delta h/h$ can with good approximation be considered equal to 0, because such flow creates differences of volumes of the dense mediums in the two tubs that are negligible in relation to the volumes of the tubs themselves.

Therefore, the densities in the two tubs 1, 2 will be:

$$\delta_1^* = 1 - 2K\lambda\left(\frac{1}{\delta_s} - 1\right) \quad (5)$$

$$\delta_2^* = 1 - 2(1-K)\lambda\left(\frac{1}{\delta_s} - 1\right)$$

which depend only on the parameters K and $\lambda$ (that are controlled and constant in the selected operating conditions, as heretofore noted), and, therefore, are constant.

The mean density, as in equation (1), can be expressed as:

$$\delta_m = \frac{\delta_1^* + \delta_2^*}{2} = 1 - \lambda\left(\frac{1}{\delta_s} - 1\right)$$

The latter equation demonstrates that, given a $\lambda$ value, i.e., for a defined mean density $\delta_m$, the difference between $\delta_1^*$ and $\delta_2^*$ depends only on K, namely, the splitter setting(s).

The difference of the densities is:

$$\delta_1^* - \delta_2^* = 2\lambda\left(\frac{1}{\delta_s} - 1\right)(1 - 2K) = (1 - \delta_m)(1 - 2K) \quad (6)$$

When λ and K are set, $\delta_1^*$ and $\delta_2^*$ can be determined, and if the two densities have at a certain time values different from $\delta_1^*$ and $\delta_2^*$, e.g., $\delta_1'$ and $\delta_2'$, the densities of the medium in the tubs 1, 2 will vary with the time (from $\delta_1'$ to $\delta_1^*$, from $\delta_2'$ to $\delta_2^*$); the steady state values $\delta_1^*$ and $\delta_2^*$ will be reached with the exponential equation:

$$\delta_1=\delta_1^*+(\delta_1'-\delta_1^*)\exp(-C\,t)$$

where C is a constant (having dimensions 1/t) which equals the ratio between the volume flow rate of dense medium entering a tub and the volume of the tub, and t is the time.

Accordingly:

$$\text{for } t = 0 \quad \delta_1 = \delta'_1$$
$$\text{for } t = \infty \quad \delta_1 = \delta_1^*$$

The steady-state value of the density $\delta_1^*$ (as well as $\delta_2^*$), will be reached at a theoretically infinite time, but practically after few minutes (TABLE 1), given the normal values of the constant C (e.g. 0.01 $sec^{-1}$).

TABLE 1

| $\frac{\delta_1-\delta_1^*}{\delta_1'-\delta_1^*}$ | t sec | t min + sec |
|---|---|---|
| 0.5 | 69.3 | 1 min 9 sec |
| 0.2 | 160.9 | 2 min 40 sec |
| 0.1 | 230.2 | 3 min 50 sec |
| 0.05 | 299.5 | 5 min |
| 0.02 | 391.2 | 6 min 31 sec |

Figure 8:
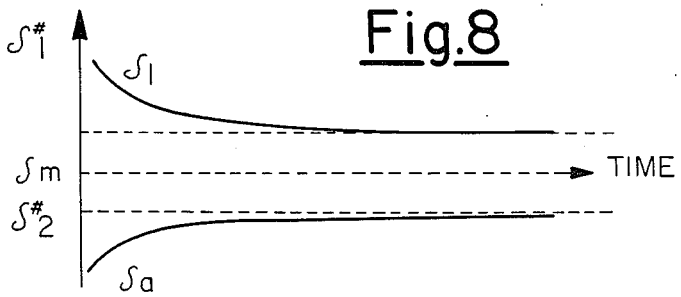
FIGS. 8 and 9 illustrate the control of the densities of the medium in the two tubs obtained in accordance with the invention.

$\delta_2^*$ will be reached with the same law starting from the value of $\delta_2'$, and the convergence is very rapid, as shown in FIG. 8.

FIG. 8 shows an example of convergence in which the starting values $\delta_1'$ and $\delta_2'$ are outside the range $\delta_1^*$–$\delta_2^*$.

Figure 9:
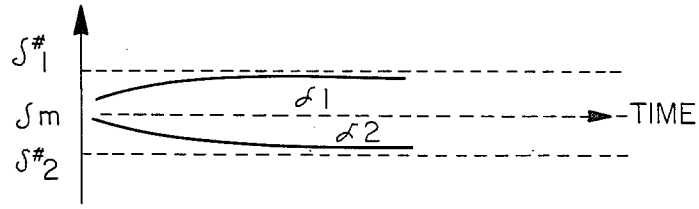

FIG. 9 below shows an analogous example in which $\delta_1'$ and $\delta_2'$ are with the range $\delta_1^*$–$\delta_2^*$.

As indicated, the starting values of $\delta_1'$ and $\delta_2'$ can be any value(s), but they in any case converge on $\delta_1^*$ and $\delta_2^*$ and thereby define for any presetting of the splitters or the value of K the manner in which the ferrosilicon or magnetite is divided between the two tubs.

In the absence of communication between the two tubs 1, 2 as by the level L above the opening 69, the levels of the free surface in the two tubs 1, 2 will not equal, Δh/h will differ from zero, and the two densities $\delta_1^*$ and $\delta_2^*$ would be impossible to control in the absence of automatic control systems for the splitters, such as the splitters 45, 46, etc, heretofore noted.

It will be understood, moreover, that the invention makes it posssible to achieve the objective as outlined above of easily converting, if so desired, an existing installation working with a medium having one density only into an installation working with a dense medium having two densities. It is apparent that the economical acceptance of such a conversion is tendered by the possibility of adopting a single loop for the feed back flows for the dense medium, rather than a twin loop, and thus requiring a comparatively reduced space without any substantial modifications of the structure of the existing installation. The separation run according to the invention can profitably be adopted not only for minerals but for any other mixture of materials having different specific gravities, such as for example metal scraps.

We claim:

1. A method of dynamic separation of mixtures of materials, such as minerals, having different specific gravities, by one dense medium having two different densities comprising the steps of (a) providing a closed loop flow system for the dense medium and within the closed loop flow system;

(b) utilizing two medium streams of two different densities of the one dense medium to separate mixtures of materials into at least two material/dense medium streams each of different density, (c) recovering the dense medium streams from the two material/dense medium streams by removing the materials therefrom, (d) splitting each recovered dense medium stream into at least two stream portions, (e) feeding each stream portion to an associated return stream to form two return streams of two different densities.

(f) conducting each return stream to an individual tub thereby establishing in the tubs the same dense medium but of two different densities, (g) creating the two medium streams of step (b) from the dense medium of the tubs of step (f), (h) effecting overflow of the dense medium between the two tubs to establish substantial equal volume therebetween, and (i) at all times maintaining balanced volumes of the dense medium in the two tubs to maintain substantial equal volume therebetween.

2. The method as defined in claim 1 including the step of providing another dense medium stream from the one dense medium within the closed loop flow systems having a density at least greater than the least dense of the two streams of step (b) and (j) increasing the density of said at least one return stream by combining therewith said another dense medium stream.

3. The method as defined in claim 1 including the step of providing another dense medium stream from the one dense medium within the closed loop flow system having a density at least greater than the most dense of the two streams of step (b) and (j) increasing the density of said at least one return stream by combining therewith said another dense medium stream.

4. The process as defined in claim 1 wherein one of the two material/dense medium streams has material grit size differing from the material grit size of the other of the two material/dense medium streams.

5. The method as defined in claim 1 wherein step (h) is performed by effecting overflow through an opening between the tubs disposed below a common free uppermost surface level of the dense medium in the tubs.

6. The method as defined in claim 5 wherein step (d) is performed following the formulae $$\delta_1 = 1 - 2K\lambda\left(\frac{1}{\delta_s} - 1\right)$$

$$\delta_2 = 1 - 2(1-K)\lambda\left(\frac{1}{\delta_s} - 1\right)$$

wherein $\delta_1$ and $\delta_2$ represent the two different densities; $\delta_s$ represents the specific gravity of the suspensoid thereof; K is the proportion of the total suspensoid in one tub, 1−K is the proportion of the total suspensoid in the other tub, and λ is the total weight of the suspensoid divided by the total volume of the two tubs.

7. The method ad defined in claim 1 wherein step (h) is performed by maintaining a common free uppermost liquid surface level of the dense medium in the two tubs spaced above the point of overflow between the two tubs.

8. The method as defined in claim 7 wherein step (d) is performed following the formulae $$\delta_1 = 1 - 2K\lambda\left(\frac{1}{\delta_s} - 1\right)$$

$$\delta_2 = 1 - 2(1 - K)\lambda\left(\frac{1}{\delta_s} - 1\right)$$

wherein $\delta_1$ and $\delta_2$ represent the two different densities; $\delta_s$ represents the specific gravity of the suspensoid thereof; K is the proportion of the total suspensoid in one tub, 1−K is the proportion of the total suspensoid in the other tub; and λ is the total weight of the suspensoid divided by the total volume of the two tubs.

9. The method as defined in claim 1 wherein step (d) is performed following the formulae $$\delta_1 = 1 - 2K\lambda\left(\frac{1}{\delta_s} - 1\right)$$

$$\delta_2 = 1 - 2(1 - K)\lambda\left(\frac{1}{\delta_s} - 1\right)$$

wherein $\delta_1$ and $\delta_2$ represent the two different densities; $\delta_s$ represents the specific gravity of the suspensoid thereof: K is the proportion of the total suspensoid in one tub; 1−K is the proportion of the total suspensoid in the other tub; and λ is the total weight of the suspensoid divided by the total volume of the two tubs.

* * * * *